US006364220B2

(12) United States Patent
Willke et al.

(10) Patent No.: US 6,364,220 B2
(45) **Date of Patent: *Apr. 2, 2002**

(54) FUEL INJECTION VALVE

(75) Inventors: Clemens Willke, Oberstenfeld; Ferdinand Reiter, Markgröningen; Willi Frank, Bamberg; Rudolf Kalb, Buttenheim; Gerfried Hirt, Bamberg; Assadollah Awarzamani, Markgröningen; Thomas Keil, Bamberg, all of (DE)

(73) Assignee: Robert Bosch GmbH, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/894,431

(22) PCT Filed: Jul. 26, 1996

(86) PCT No.: PCT/DE96/01391

§ 371 Date: Feb. 12, 1998

§ 102(e) Date: Feb. 12, 1998

(87) PCT Pub. No.: WO97/22798

PCT Pub. Date: Jun. 26, 1997

(30) Foreign Application Priority Data

Dec. 19, 1995 (DE) ..... 195 47 406

(51) Int. Cl.[7] ..... F02M 51/00

(52) U.S. Cl. ..... 239/585.1; 239/585.4; 239/900

(58) Field of Search ..... 239/585.1, 585.2, 239/585.3, 585.4, 585.5, 900; 251/129.21, 129.15, 129.01

(56) References Cited

U.S. PATENT DOCUMENTS

| | | | | | |
|---|---|---|---|---|---|
| 3,865,312 | A | * | 2/1975 | Lombard et al. | 239/585.1 |
| 4,515,129 | A | * | 5/1985 | Stettner | 239/585.3 |
| 4,597,558 | A | * | 7/1986 | Hafner e tal. | 239/585.1 |
| 4,643,359 | A | * | 2/1987 | Casey | 239/585.4 |
| 4,944,486 | A | * | 7/1990 | Babitzka | 239/585.4 |
| 4,946,107 | A | | 8/1990 | Hunt | 239/585 |
| 5,035,360 | A | * | 7/1991 | Green et al. | 239/585.3 |
| 5,178,332 | A | * | 1/1993 | Tsukakoshi et al. | 239/585.3 |
| 5,190,223 | A | * | 3/1993 | Mesenich | 239/585.5 |
| 5,269,281 | A | | 12/1993 | Hafner | |
| 5,560,386 | A | | 10/1996 | Reiter et al. | 137/1 |
| 5,944,262 | A | * | 8/1999 | Akutagawa et al. | 239/585.4 |
| 5,975,436 | A | * | 11/1999 | Reiter et al. | 239/585.1 |
| 5,996,910 | A | * | 12/1999 | Takeda et al. | 239/585.1 |
| 6,012,655 | A | * | 1/2000 | Maier | 239/585.4 |

FOREIGN PATENT DOCUMENTS

DE 39 31 490 4/1991

* cited by examiner

*Primary Examiner*—Lesley D. Morris
*Assistant Examiner*—Christopher S. Kim
(74) *Attorney, Agent, or Firm*—Kenyon & Kenyon

(57) ABSTRACT

A fuel injector for fuel-injection systems of internal combustion engines which includes an elongated, axially running, thin-walled, non-magnetic sleeve. At its downstream end, the sleeve has a bottom section, which runs substantially normal to the otherwise axial extent of the sleeve along a longitudinal valve axis. A valve needle, which is securely joined to an armature and a valve-closure member, can move axially within a feed-through opening of the sleeve. The valve-closure member cooperates with a valve-seat surface provided on a valve-seat body, the valve-seat body being pressed into the sleeve and likewise abutting, for example, on the bottom section of the sleeve. The sleeve constituted as a drawn sheet-metal part extends axially over more than half of the axial length of the fuel injector. The fuel injector is suited for applications in fuel-injection systems of mixture-compressing internal combustion engines having externally supplied ignition.

32 Claims, 5 Drawing Sheets

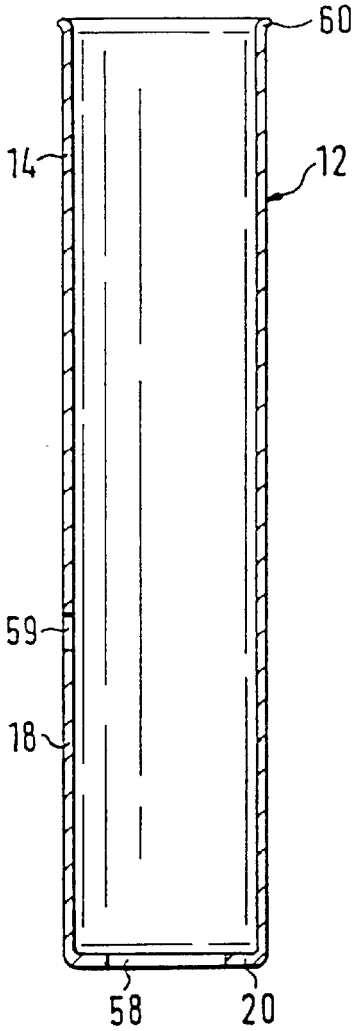
Fig. 2
Fig. 3
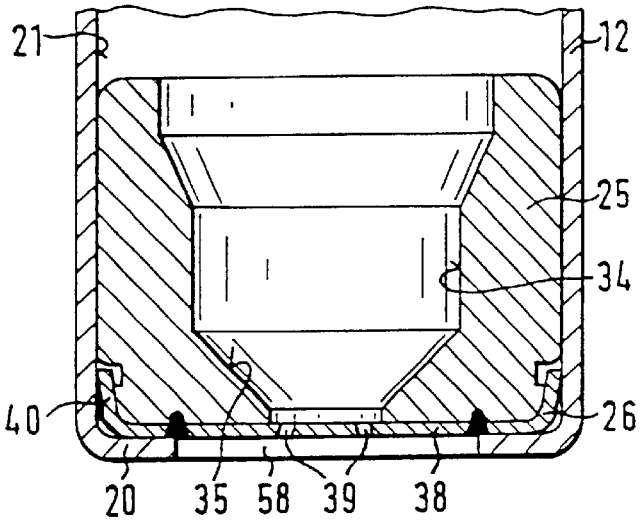
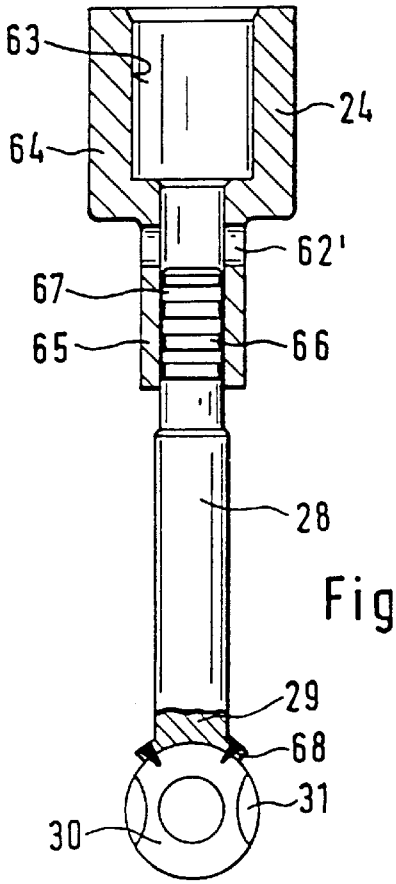
Fig. 4

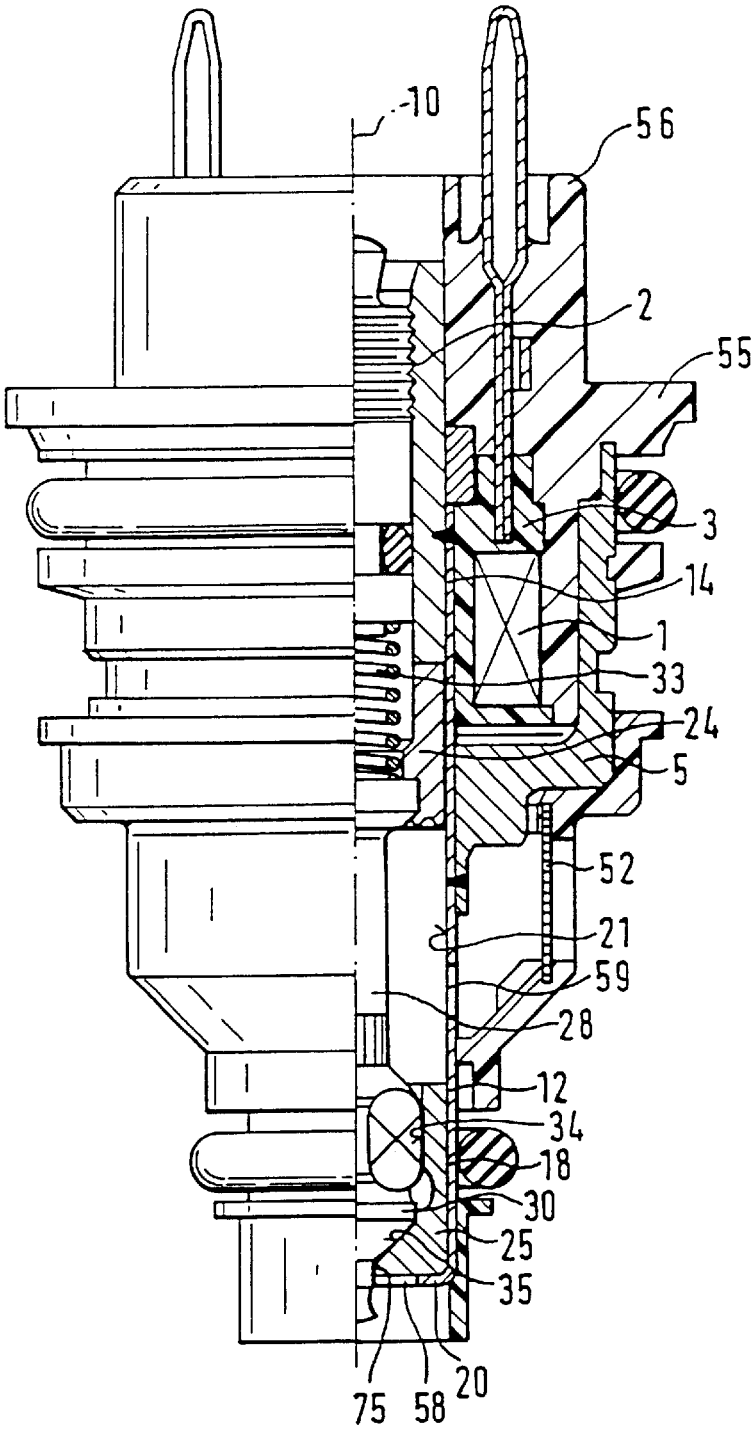
Fig. 8
Fig. 9
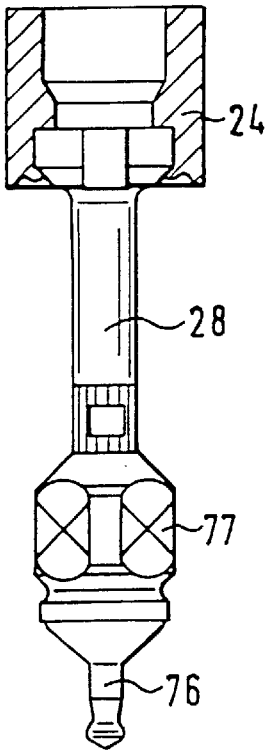

FUEL INJECTION VALVE

FIELD OF THE INVENTION

The present invention relates to a fuel injector.

BACKGROUND INFORMATION

U.S. Pat. No. 4,946,107 describes an electromagnetically operable fuel injection valve, which has a non-magnetic sleeve as a connecting part between a core and a valve-seat body. The sleeve is securely fixed with its two axial ends to the core and to the valve-seat body. The sleeve has a constant external diameter and a constant internal diameter over its entire axial length and, accordingly, has same-size inlet orifices at both of its ends. The core and the valve-seat body are so formed with respect to their outer diameter that they extend into the sleeve at both ends, so that the sleeve fully surrounds the two component parts, core and valve-seat body, in these inwardly projecting areas. A valve needle moves axially within the sleeve and has an armature which is guided through the sleeve. The sleeve is permanently joined to the core and to the valve-seat body by welding, for example, as described in German Patent Application No. 43 10 819, which also describes using a thin-walled, non-magnetic sleeve as a connecting part between the core and valve-seat body of a fuel injector. In terms of its structural design, this sleeve corresponds substantially to the sleeve described in U.S. Pat. No. 4,946,107. The tubular sleeves make it possible to reduce the volume and the weight of the fuel injectors.

ADVANTAGES OF THE INVENTION

One of the advantages of the fuel injector of the present invention is that it makes it possible, in a simple and cost-effective manner, to further diminish the volume and weight of the fuel injector and to fulfill a greater number of functions using only one sleeve-shaped component part. In addition to the benefit of lower manufacturing costs, it is also simpler to assemble the fuel injector because it entails comparatively few production steps. The present invention achieves these advantages by employing a thin-walled, non-magnetic sleeve as a connecting part between a core and a valve-seat body in the fuel injector, said non-magnetic sleeve also fulfilling the retaining, supporting or holding (seating) functions. Thus at its one axial end, the sleeve has a bottom section which runs normal to the axial extent of the sleeve and which assures an optimal and secure attachment of the valve-seat body and increases sleeve stability. A major factor in reducing the volume and weight is that the sleeve extends over more than half of the axial length of the fuel injector and can, therefore, even assume the function of a fuel intake fitting.

It is also advantageous to press a valve-seat body having a valve-seat surface into the sleeve, the bottom section of the sleeve providing a contact surface to prevent the valve-seat body from slipping.

It is further advantageous to produce the sleeve by deep drawing the sheet metal, as this method is simple and economical and, nevertheless, meets the required precision.

For "side-feed" injectors, which are partially traversed by a transverse flow, it is advantageous to provide bores or orifices in the inner sleeve wall to assure a direct fuel supply to the spray orifices of the fuel injector.

One particular benefit is attained by providing the bottom section of the sleeve with the spray orifices for metering fuel arranged therein. This is especially cost-effective, since one can then eliminate one component part (spray-orifice plate) and its associated joint.

It is also advantageous to design the sleeve to be long enough to extend over the entire axial extension length of the fuel injector. This enables the sleeve to assume the function of a fuel intake fitting as well. Furthermore, the core can be easily pressed into the sleeve, making it simple to adjust the valve needle lift Moreover, the problem of seal tightness toward the interior valve space is eliminated in this long sleeve arrangement. A top sealing ring provides a direct sealing action on the sleeve.

Another advantage achieved by the sleeve configuration is that valve needles or armatures of the same design can be installed for completely different types of valves.

BRIEF DESCRIPTION OF THE DRAWINGS

FIG. 2 shows an embodiment of a sleeve according to the present invention.

FIG. 3 shows a first embodiment of a downstream end of the sleeve with the valve-seat body installed.

FIG. 4 shows a first embodiment of a valve needle that can be installed in the fuel injector.

FIG. 8 shows a fourth embodiment of the fuel injector in the form of a seed-feed injector.

FIG. 9 shows a second embodiment of the valve needle that can be installed in the fuel injector.

DETAILED DESCRIPTION OF THE INVENTION

Figure 1:
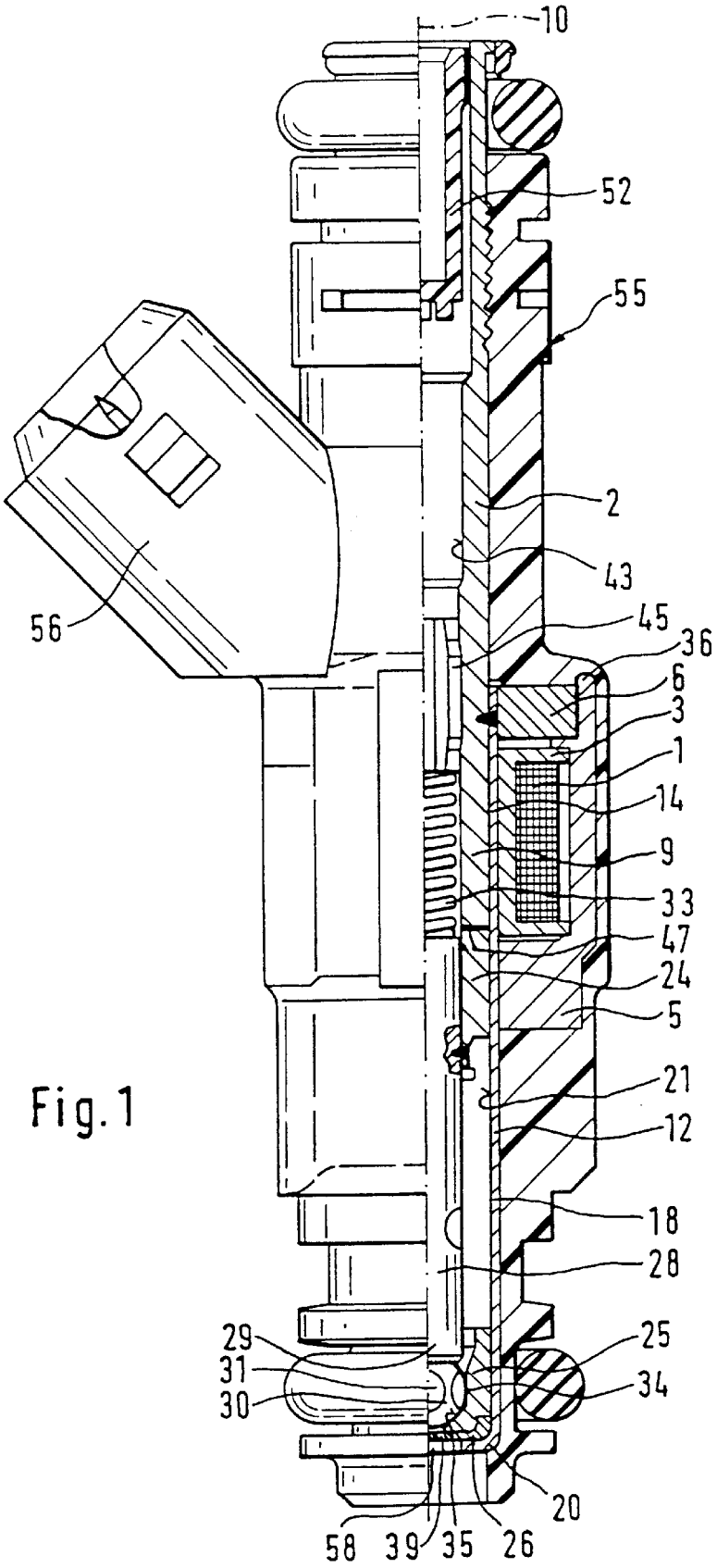
FIG. 1 shows a first embodiment of a fuel injector according to the present invention.

The electromagnetically actuated valve illustrated in FIG. 1, for example as a first embodiment in the form of an injector for fuel-injection systems of mixture-compressing internal combustion engines having externally supplied ignition, has a tubular core 2 surrounded by a solenoid coil 1, and is used as a fuel intake fitting. A bobbin core 3 holds a winding of solenoid coil 1 and, in conjunction with core 2 having a constant outer diameter, makes it possible to design the injector to be especially compact and short in the area of solenoid coil 1. Solenoid coil 1 is embedded with its bobbin core 3, e.g. in a pot-shaped magnetic housing 5, i.e., it is completely surrounded by magnetic housing 5 in the circumferential direction and toward the bottom. A cover element 6 that is insertable into extruded magnetic housing 5 assures that solenoid coil 1 is covered to the top and, thus, that solenoid coil 1 is completely enclosed, and is used for closing the magnetic circuit. In general, this type of pot-shaped construction keeps magnetic housing 5, together with solenoid coil 1, dry. There is no need to provide for additional sealing.

Joined imperviously, e.g. by means of welding, to a lower core end 9 of core 2 and concentrically to a longitudinal valve axis 10, is a tubular and thin-walled sleeve 12 used as a connecting part, which in this context with an upper sleeve section 14 partially axially surrounds core end 9. Bobbin core 3 overlaps sleeve section 14 of sleeve 12 at least partially axially. Over its entire axial extent, bobbin core 3 has, namely, a larger inner diameter than the diameter of sleeve 12 in its upper sleeve section 14. Tubular sleeve 12, e.g., of non-magnetic steel, extends downstream with a bottom sleeve section 18 to a bottom section 20 that forms downstream closure of sleeve 12 and extends normal to the axial extent of sleeve 12.

Sleeve 12 thus has a tubular form over its entire axial length, but in its entirety, together with bottom section 20, is cup-shaped. In this context, over its entire axial extent to bottom section 20, sleeve 12 forms a feed-through opening 21 having a substantially constant diameter, which runs concentrically to longitudinal valve axis 10. With its bottom sleeve section 18, sleeve 12 surrounds an armature 24 and, further downstream, a valve-seat body 25. A spray-orifice plate 26 that is, e.g., permanently fixed to valve-seat body 25, is surrounded by sleeve 12, in the circumferential direction by sleeve section 18 and, in the radial direction, by bottom section 20. Sleeve 12 is thus not only a connecting part, but also fulfills retaining, supporting or holding functions, in particular for valve-seat body 25, so that sleeve 12 effectively also constitutes the valve-seat support. Disposed in passage 21 is, e.g., a tubular valve needle 28, which is joined, e.g. by welding, at its downstream end 29 facing spray-orifice plate 26 to, e.g., a spherical valve-closure member 30, on whose periphery are provided, for example, five flattened areas 31 allowing the fuel to be spray-discharged to flow past.

The injector is actuated electromagnetically, e.g., in a conventional manner. The electromagnetic circuit includes solenoid coil 1, core 2, magnetic housing 5, and armature 24 for axially moving valve needle 28 and, thus, for opening the injector against the spring force of a return spring 33, or for closing it. Armature 24 is joined to the end of valve needle 28 facing away from valve-closure member 30, e.g. by a weld, and is aligned to core 2. A guide opening 34 of valve-seat body 25 is used for guiding valve-closure member 30 during the axial movement of valve needle 28, together with armature 24, along longitudinal valve axis 10. Moreover, armature 24 is guided during the axial movement in sleeve 12. For cost reasons, it is beneficial for magnetic housing 5 and armature 24 to be manufactured from an extruded part in a lathe fixture. Cover element 6 is, e.g., a stamped part that is fastened to magnetic housing 5 by a jointed-flange connection 36, following installation of solenoid coil 1 in magnetic housing 5.

Spherical valve-closure member 30 cooperates with a valve-seat surface 35 of valve-seat body 25, said valve-seat surface 35 tapering frustoconically in the direction of flow and being formed in the axial direction downstream from guide opening 34. At its front end facing away from valve-closure member 30, valve-seat body 25 is concentrically and securely joined to, e.g. saucer-shaped spray-orifice plate 26, e.g., by a weld, as shown in FIG. 3.

Inserted into a graduated flow-through bore 43 of core 2 that runs concentrically to longitudinal valve axis 10 and is used for supplying fuel in the direction of the valve seat, in particular of valve-seat surface 35, is an adjusting sleeve 45. Adjusting sleeve 45 is used for adjusting the resilience of return spring 33 that adjoins it, said return spring 33, in turn, being braced with its opposite side against valve needle 28.

The depth of insertion of valve-seat body 25 having saucer-shaped spray-orifice plate 26 is decisive, among other things, for the lift of valve needle 28. It is essentially already set by the spatial position of bottom section 20 of sleeve 12. In this context, the one end position of valve needle 28 is defined, given a de-energized solenoid coil 1, by the valve-closure member's 30 contact making on valve-seat surface 35 of valve-seat body 25, while the other end position of valve needle 28, given an energized solenoid coil 1, results from armature's 24 contact making on core end 9. To prevent magnetic sticking, provision can be made between armature 24 and core end 9 for a limit-stop washer 47 made, e.g. of a non-magnetic, wear-resistant, hard-rolled material. Thus, one can then prevent the surfaces of core 2 and armature 24 from being coated (e.g., chromized) in their limit-stop areas. The limit-stop areas on core 2 and armature 24 are cold work-hardened and compressed in a smoothing-rolling operation. Moreover, the lift is adjusted by axially shifting core 2 in upper sleeve section 14 of sleeve 12, said core 2 being pressed in with little (not substantially tight) interference. Core 2 is then securely joined in the appropriate, desired position to sleeve 12, a laser weld being useful on the periphery of sleeve 12. The jointing excess (interference) of the press fit can also be selected to be large enough to absorb any occurring forces and to guarantee complete seal tightness, thus making it possible to eliminate a welding operation.

A fuel filter 52 projects into the inflow end of flow-through bore 43 of core 2 and assures that those fuel components are filtered out, which, because of their size, could block or damage the injector. The ready adjusted injector is substantially enclosed by a plastic extrusion coat 55, which starts out from core 2, extending axially over solenoid coil 1 up to sleeve 12, and even extends downstream past bottom section 20 of sleeve 12, an electrical plug connector 56 also being extruded on along with said plastic extrusion coat 55. Solenoid coil 1 is electrically contacted and, thus, energized via electrical plug connector 56.

Using the relatively inexpensive sleeve 12 makes it possible for one to do without the lathed parts customarily found in injectors, such as valve-seat supports or nozzle holders, which, because of their larger outer diameter, are more voluminous and more expensive to manufacture than sleeve 12. In FIG. 2, sleeve 12 of the first embodiment shown in FIG. 1 is depicted as a single component part on a different scale. Thin-walled sleeve 12 is formed, e.g., by deep-drawing, a non-magnetic material, such as rust-resistant CrNi steel being used as a material. Sleeve 12 constituted as a drawn sheet-metal part is used, as described above, because of its large extent, for accommodating valve-seat body 25, spray-orifice plate 26, valve needle 28 with armature 24, return spring 33, as well as at least partially core 2 and, consequently, also the lift-limiting limit-stop area of armature 24 and core 2. In its bottom section 20, the sleeve 12 has a centrally disposed outlet orifice 58 with a diameter large enough to allow the fuel that is spray-discharged through spray orifices 39 of spray-orifice plate 26 to leave the injector unimpeded. If the intention is to use sleeve 12 in a "seed-feed" injector, as shown in FIG. 8, then provision can easily be made in sleeve 12 for inlet orifices 59, which permit fuel to enter into the interior of sleeve 12. The top-feed injector shown in FIG. 1 has a sleeve 12 that does not have any inlet orifices 59, since the fuel enters along longitudinal valve axis 10, axially via flow-through bore 43, into sleeve 12. At its axial end opposing bottom section 20, sleeve 12 has, for example, a peripheral rim 60 that is bent slightly radially to the outside. Peripheral rim 60 is formed by dissociating spillover (excess) material during the deep-drawing process. The preassembled subassembly includes solenoid coil 1, bobbin core 3, magnetic housing 5 and cover element 6 is slid axially onto the periphery of sleeve 12, a delimiting effect by peripheral rim 60 and a clamping of cover element 6 in the assembled state being possible.

Bobbin core 3, magnetic housing 5, and cover element 6 all have centrally disposed feed-through openings, through which sleeve 12 then extends.

FIGS. 2 and 3 show bottom sleeve section 18 and bottom section 20, together with an installed valve-seat body 25, as well as with a spray-orifice plate 26 attached thereto. Besides a bottom part 38, to which valve-seat body 25 is secured and in which run at least one, (e.g. four), spray-discharge orifice 39 formed through erosion or stamping, saucer-shaped spray-orifice plate 26 also has an upstream, circumferential retention rim 40. Retention rim 40 is bent upstream conically outwardly, so that it abuts on the inner wall of sleeve 12 defined by feed-through opening 21, a radial pressing (squeezing) being given. Valve-seat body 25 is pressed in cold into sleeve 12 and is not welded. The pressing, e.g. into feed-through opening 21 of sleeve 12, is carried out until spray-orifice plate 26, which is secured, e.g., by welding to valve-seat body 25, abuts with its bottom part 38 on bottom section 20 of sleeve 12. At its end, retention rim 40 of spray-orifice plate 26 has a slightly larger diameter than the diameter of feed-through opening 21 of sleeve 12, so that retention rim 40 presses at its end against sleeve 12, thus in addition to pressing in valve-seat body 25, safeguards against a slipping of valve-seat body 25.

As an alternative to sleeve-shaped valve needle 28 shown in FIG. 1, another embodiment of a valve needle 28 in the injector is shown by FIG. 4. In this embodiment, valve needle 28 is designed as an oblong, solid component. Thus, it is no longer possible for the fuel to be supplied within valve needle 28 in the direction of valve-seat surface 35. Therefore, provision is already made in armature 24 for outlet orifices 62', through which the fuel arriving from an inner orifice 63 of armature 24 can flow, to then arrive outside of valve needle 28, further downstream, in feed-through opening 21 of sleeve 12. Armature 24 has, e.g., a stepped design, a top, upstream armature section 64 having a larger diameter than a bottom downstream armature section 65. Opening 63 running inside of armature 24 has a smaller cross-section in bottom armature section 65 than in top armature section 64. Outlet bores 62' are provided, e.g., as radially running transverse bores in the wall of bottom armature section 65. A permanent connection of armature 24 and valve needle 28 is achieved, e.g., in that armature 24 is pressed onto upstream end 66 of valve needle 28, since there is an interference fit between valve needle 28, at least at its end 66 to be pressed in, and orifice 63. Provision is made at end 66 of valve needle 28, for example, for a few circumferential, e.g., crimped grooves 67, which are used for latching armature 24 after it has been pressed on valve needle 28.

After the press-in operation, valve needle 28 extends with its end 66 only so far into orifice 63 that outlet orifices 62' still remain completely free. An alternative jointing method, however, is the laser welding operation (shown in FIG. 1). Valve needle 28 and spherical valve-closure member 30 are permanently joined, e.g., by the laser welding operation, valve needle 28, at its downstream end facing away from armature 24, having an upset, collar-shaped attachment flange 68. Attachment flange 68 is formed to conform to the radius of spherical valve-closure member 30.

Figure 5:
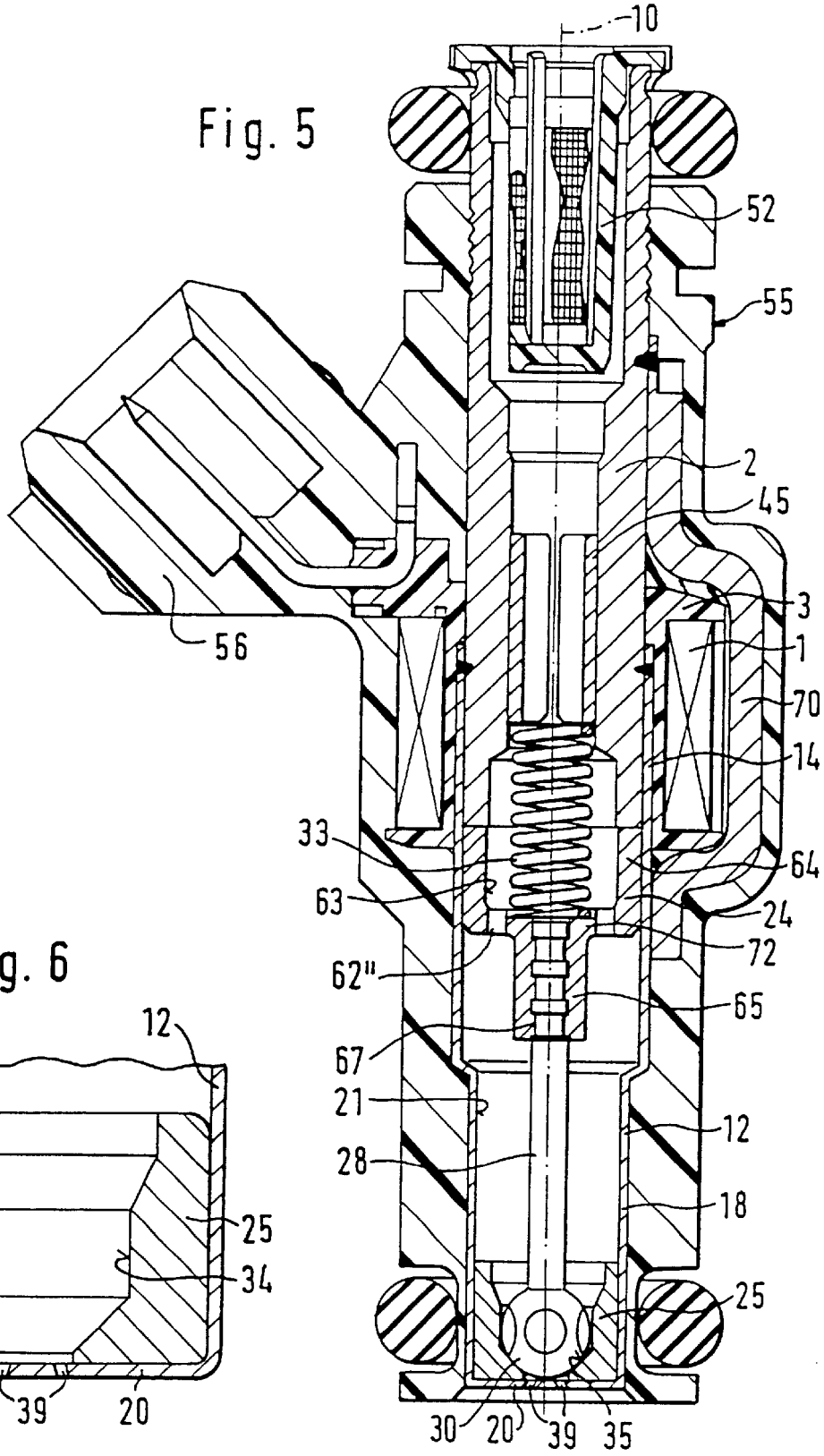
FIG. 5 shows a second embodiment of the fuel injector according to the present invention.

The fuel injector shown in FIG. 5 substantially corresponds in its basic design to the injector shown in FIG. 1. Therefore, the following will only describe those components or subassemblies having a different design. Parts that have remained the same or that have equivalent functions as those in FIG. 1 are characterized by the same reference symbols in all further exemplary embodiments. In place of magnetic housing 5, solenoid coil 1 is surrounded by at least one conductive element 70 designed, e.g., as a bracket and being used as a ferromagnetic element. Conductive element 70 circumferentially surrounds solenoid coil 1, at least partially, and fits with its one end on core 2 and with its other end on sleeve 12, e.g., in the area of top sleeve section 14, and is able to be joined to sleeve section 14, e.g., by means of welding, soldering, or cementing. Another distinguishing feature lies in the embodiment of armature 24. In contrast to armature 24 shown in FIG. 4 whose outlet bores 62' run radially, outlet bores 62" are now designed to run axially and, to be specific, in a transition region 72, which represents a step between top armature section 64 and bottom armature section 65.

The important distinction pertains, however, to the design of sleeve 12. The stepped, thin-walled, non-magnetic sleeve 12, e.g., is so designed that top sleeve section 14 guiding armature 24 has a slightly larger diameter than bottom sleeve section 18, feed-through opening 21 of sleeve 12 being reduced to the same extent in the downstream direction. Moreover, bottom section 20 of sleeve 12 assumes the functions of a spray-orifice plate, so that spray-orifice plate 26 can be omitted. Similarly to the known spray-orifice plates, base section 20 has at least one, e.g., four spray orifices 39, which are introduced, e.g., by means of stamping or erosion.

Figure 6:
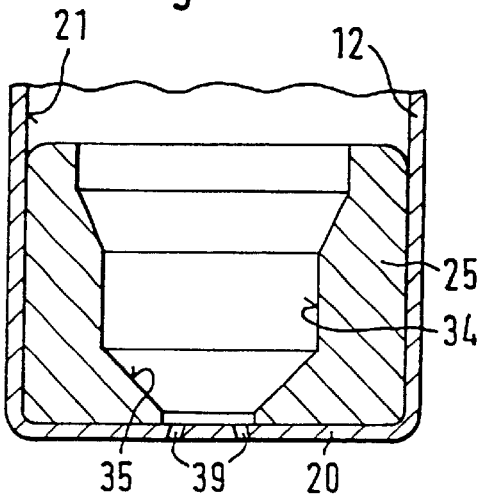
FIG. 6 shows a second embodiment of the downstream end of the sleeve with the valve-seat body installed.

As shown in FIG. 6, which conforms to FIG. 3, valve-seat body 25 and sleeve 12 are again shown on an enlarged scale in the area of bottom section 20. Bottom section 20 is designed as a conventional spray-orifice plate and, thus, does not have any outlet orifice 58, but rather only spray orifices 39 for metering the fuel. In addition to the connecting, holding and supporting functions already described, sleeve 12 now also fulfills a metering and spray-discharge function. Valve-seat body 25 can either be imperviously welded to sleeve 12 in the area of bottom section 20 and/or in the area of bottom sleeve section 18, or be pressed imperviously into sleeve 12. The benefit of this arrangement is that it eliminates the need for one component (spray-orifice plate 26), as well as for at least one joint. Moreover, sleeve 12, together with said bottom section 20, is rendered more rigid, lessening the risk of damage to the valve components during handling.

Figure 7:
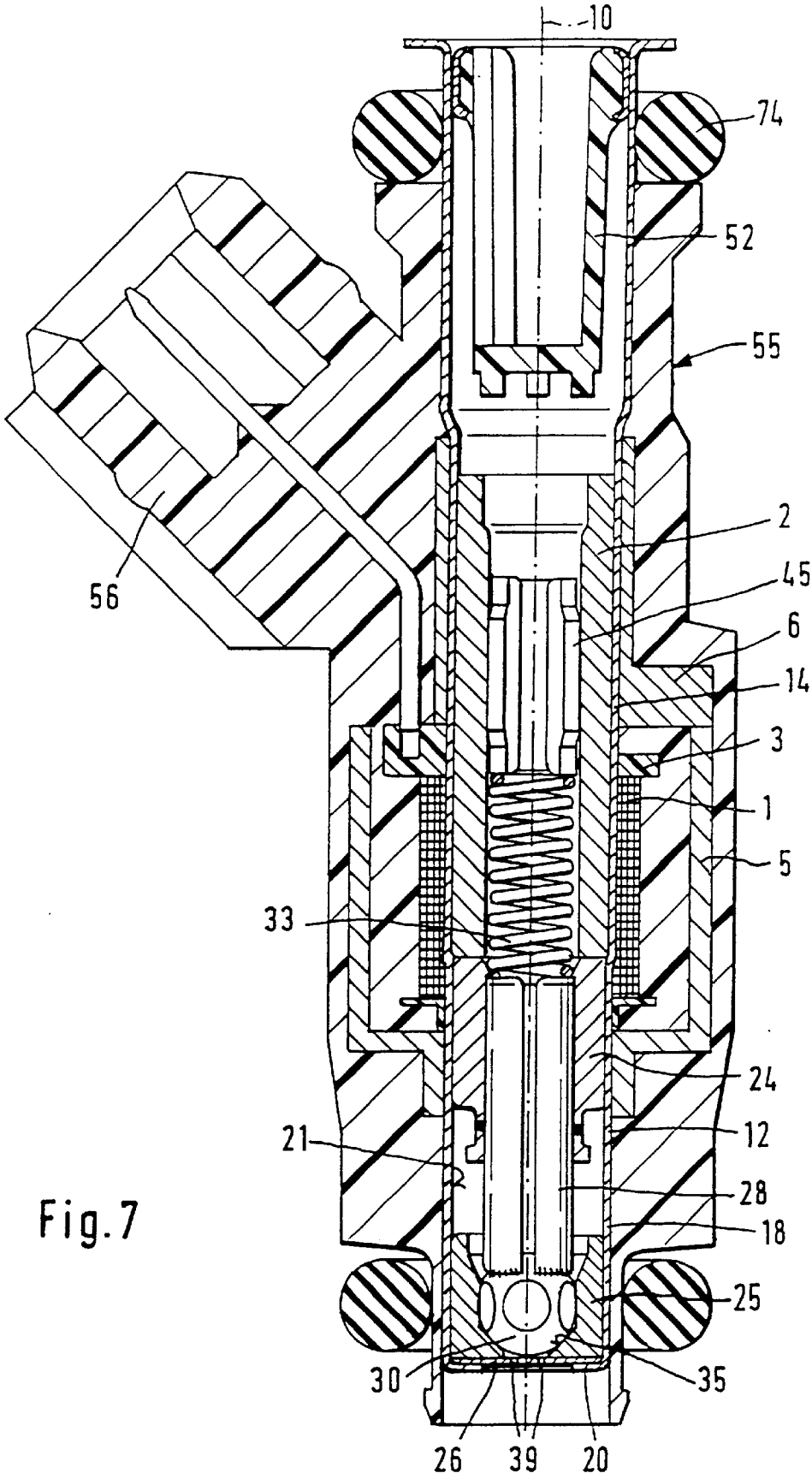
FIG. 7 shows a third embodiment of the fuel injector according to the present invention.

While in the preceding embodiments, sleeve 12 always extended over approximately ⅔ of the injector's length, the injector shown in FIG. 7 uses, as a valve base, a sleeve 12 which itself predefines the length of the injector and, thus, also runs nearly over the entire length of the injector. The advantage of sleeve 12 that traverses the injector is that there is no longer a need for joints that adversely affect seal tightness. Therefore, a laser welding on sleeve 12 is not necessary, because a top sealing ring 74 provides a direct sealing action on sleeve 12. Moreover, the lift adjustment can be carried out very easily. For this, core 2 is pressed so far into sleeve 12 from the inflow end of the fuel injector until the lift of valve needle 28 reaches the desired magnitude. After that, the adjusted lift is no longer negatively influenced by other assembly steps. As an alternative to the version shown in FIG. 7, bottom section 20 can also directly have spray orifices 39 (compare FIGS. 5 and 6).

The injector is easily assembled, e.g., in that first solenoid coil 1, magnetic housing 5, and cover element 6 (or optionally at least one conductive element 70) are mounted on sleeve 12, plastic coat 55 is then extrusion-coated on, valve-seat body 25 is subsequently pressed into sleeve 12, and valve needle 28, together with armature 24, are introduced, and core 2 is then pressed in so far until the nominal lift is reached. All of the subsequent assembly steps are already sufficiently known. Sleeve 12 is designed, e.g., so as to be stepped twice over its axial length, the cross-section of feed-through opening 21 being reduced slightly in each case in the downstream direction. The steps provided, e.g., in the limit-stop area of armature 24 and core 2, as well as above core 2 facilitate assembly.

FIGS. 8 and 9 show that a sleeve 12 according to the present invention can also be installed in completely different valve types, e.g., in "side-feed" injectors. A further description of such injector will not be provided, as it is already known, at least in terms of its basic design, from the German Patent Application No. 39 31 490 and can be gleaned from there. Valve needle 28 shown in FIG. 9 includes a nozzle pintle 76 that extends into a centrally disposed valve-seat body bore 75 of valve-seat body 25 can have a simplified design as compared to known valve needles of comparable injectors by providing only one guide section 77. Usually such valve needles have two guide sections 77. Moreover, valve needle 28 is guided through armature 24 in sleeve 12. As already shown in FIG. 2, for applications in side-feed injectors, sleeve 12 can have at least one inlet orifice 59, via which fuel is supplied in the direction of valve-seat surface 35.

What is claimed is:

1. A fuel injector for a fuel-injection system of an internal combustion engine, comprising:

a valve-seat body;

a valve seat situated on the valve-seat body;

a thin-walled axially-extending non-magnetic sleeve including a bottom section at a downstream end of the sleeve, the bottom section extending substantially normal to the sleeve, the valve-seat body being axially and radially surrounded by the sleeve; and a valve needle including a valve-closure member, the valve needle being axially movable in the sleeve along a longitudinal valve axis of the fuel injector and cooperating with the valve seat.

2. The fuel injector according to claim 1, wherein the sleeve has a first axial length that is more than half of a second axial length of the fuel injector.

3. The fuel injector according to claim 1, wherein the sleeve includes a drawn sheet-metal part.

4. The fuel injector according to claim 1, wherein the valve-seat body is pressed into the sleeve, the valve-seat body including a bottom section and an axially running bottom sleeve section for contacting the sleeve.

5. The fuel injector according to claim 1, wherein the sleeve includes an axially extending wall, the wall having at least one inlet orifice.

6. The fuel injector according to claim 1, wherein the bottom section has an outlet orifice, and wherein fuel pre-metered upstream from the bottom section flows through the outlet orifice and emerges unimpeded.

7. The fuel injector according to claim 1, wherein the bottom section has an outlet orifice, and further comprising:

a spray-orifice plate securely joined to the valve-seat body at a body downstream end of the valve-seat body and including at least one spray orifice, the spray-orifice plate at least partially contacting on the bottom section, the at least one spray orifice cooperating with the outlet orifice.

8. The fuel injector according to claim 1, wherein the bottom section has at least one spray orifice to generate a fuel-metering effect.

9. The fuel injector according to claim 1, wherein the sleeve includes a feed-through opening and at least one step to form a stepped shape extending along an axial length of the sleeve, the feed-through opening having a diameter being reduced with each of the at least one step in a downstream direction.

10. The fuel injector according to claim 1, wherein the sleeve extends along an axial length of the fuel injector.

11. The fuel injector according to claim 1, further comprising:

a coat surrounding the sleeve.

12. The fuel injector according to claim 11, wherein the coat is a plastic extrusion coat.

13. The fuel injector according to claim 1, further comprising:

a magnet core arranged inside the sleeve;

an armature arranged inside the sleeve;

a magnet coil arranged outside of the sleeve; and a magnetic housing arranged outside of the sleeve, wherein the magnet coil, the armature and the magnetic housing form an electromagnetic circuit for axially moving the valve needle, and the magnetic housing is arranged outside of the magnet coil.

14. The fuel injector according to claim 1, wherein:

the sleeve has a first axial length that is more than half of a second axial length of the fuel injector; and the sleeve includes a drawn sheet-metal part.

15. The fuel injector according to claim 1, wherein:

the valve-seat body is pressed into the sleeve, the valve-seat body including a bottom section and an axially running bottom sleeve section for contacting the sleeve; and the sleeve includes an axially extending wall, the wall having at least one inlet orifice.

16. The fuel injector according to claim 1, wherein:

the sleeve has a first axial length that is more than half of a second axial length of the fuel injector;

the sleeve includes a drawn sheet-metal part;

the valve-seat body is pressed into the sleeve, the valve-seat body including a bottom section and an axially running bottom sleeve section for contacting the sleeve; and the sleeve includes an axially extending wall, the wall having at least one inlet orifice.

17. The fuel injector according to claim 16, wherein a plastic extrusion coat directly surrounds the sleeve.

18. The fuel injector according to claim 16, further comprising:

a magnet core arranged inside the sleeve;

an armature arranged inside the sleeve;

a magnet coil arranged outside of the sleeve; and a magnetic housing arranged outside of the sleeve, wherein the magnet coil, the armature and the magnetic housing form an electromagnetic circuit for axially moving the valve needle, and the magnetic housing is arranged outside of the magnet coil.

19. The fuel injector according to claim 18, wherein a plastic extrusion coat directly surrounds the sleeve.

20. The fuel injector according to claim 1, wherein the bottom section includes an outlet orifice, and fuel pre-metered upstream from the bottom section flows through the outlet orifice and emerges unimpeded, and further comprising:

a spray-orifice plate securely joined to the valve-seat body at a body downstream end of the valve-seat body and including at least one spray orifice, the spray-orifice plate at least partially contacting on the bottom section, the at least one spray orifice cooperating with the outlet orifice, the at least one spray orifice providing a fuel-metering effect.

21. The fuel injector according to claim 20, wherein a plastic extrusion coat directly surrounds the sleeve.

22. The fuel injector according to claim 20, wherein:

the sleeve has a first axial length that is more than half of a second axial length of the fuel injector;

the sleeve includes a drawn sheet-metal part;

the valve-seat body is pressed into the sleeve, the valve-seat body including a bottom section and an axially running bottom sleeve section for contacting the sleeve; and the sleeve includes an axially extending wall, the wall having at least one inlet orifice.

23. The fuel injector according to claim 22, wherein a plastic extrusion coat directly surrounds the sleeve.

24. The fuel injector according to claim 20, further comprising:

a magnet core arranged inside the sleeve;

an armature arranged inside the sleeve;

a magnet coil arranged outside of the sleeve; and a magnetic housing arranged outside of the sleeve, wherein the magnet coil, the armature and the magnetic housing form an electromagnetic circuit for axially moving the valve needle, and the magnetic housing is arranged outside of the magnet coil.

25. The fuel injector according to claim 24, wherein a plastic extrusion coat directly surrounds the sleeve.

26. The fuel injector according to claim 22, wherein:

the sleeve includes a feed-through opening and at least one step to form a stepped shape extending along an axial length of the sleeve, the feed-through opening having a diameter being reduced with each of the at least one step in a downstream direction; and the sleeve extends along an axial length of the fuel injector.

27. The fuel injector according to claim 26, wherein a plastic extrusion coat directly surrounds the sleeve.

28. The fuel injector according to claim 22, further comprising:

a magnet core arranged inside the sleeve;

an armature arranged inside the sleeve;

a magnet coil arranged outside of the sleeve; and a magnetic housing arranged outside of the sleeve, wherein the magnet coil, the armature and the magnetic housing form an electromagnetic circuit for axially moving the valve needle, and the magnetic housing is arranged outside of the magnet coil.

29. The fuel injector according to claim 28, wherein a plastic extrusion coat directly surrounds the sleeve.

30. The fuel injector according to claim 28, wherein:

the sleeve includes a feed-through opening and at least one step to form a stepped shape extending along an axial length of the sleeve, the feed-through opening having a diameter being reduced with each of the at least one step in a downstream direction; and the sleeve extends along an axial length of the fuel injector.

31. The fuel injector according to claim 30, wherein a plastic extrusion coat directly surrounds the sleeve.

32. The fuel injector according to claim 1, wherein a plastic extrusion coat directly surrounds the sleeve.

* * * * *